US005413640A

United States Patent [19]

Manabe et al.

[11] Patent Number: 5,413,640

[45] Date of Patent: May 9, 1995

[54] METHOD OF PRODUCING NON-ORIENTED ELECTROMAGNETIC STEEL STRIP HAVING SUPERIOR MAGNETIC PROPERTIES AND APPEARANCE

[75] Inventors: Masahiko Manabe, Chiba; Kazumi Morita, Okayama; Yoshinari Muro; Takahiro Kan, both of Chiba; Yoshiaki Iida, Okayama; Hideo Kobayashi; Takashi Obara, both of Chiba, all of Japan

[73] Assignee: Kawasaki Steel Corporation, Japan

[21] Appl. No.: 39,529

[22] Filed: Mar. 29, 1993

Related U.S. Application Data

[63] Continuation of Ser. No. 804,830, Dec. 6, 1991, abandoned.

[30] Foreign Application Priority Data

Dec. 10, 1990 [JP] Japan ..... 2-401048
Oct. 23, 1991 [JP] Japan ..... 3-275138

[51] Int. Cl.[6] ..... C21D 9/46

[52] U.S. Cl. ..... 148/111; 148/112; 148/120; 148/121

[58] Field of Search ..... 148/111, 112, 120, 121

[56] References Cited

U.S. PATENT DOCUMENTS 4,898,627 2/1990 Schoen ..... 148/111

FOREIGN PATENT DOCUMENTS 01-191741 8/1989 Japan .
742471 6/1980 U.S.S.R. .

*Primary Examiner*—Richard O. Dean
*Assistant Examiner*—Sikyin Ip
*Attorney, Agent, or Firm*—Austin R. Miller

[57] ABSTRACT

A method of producing a non-oriented electromagnetic steel strip by subjecting a low-carbon steel slab to hot-rolling, cold rolling at a small reduction and first annealing. In order to improve magnetic flux density and surface appearance of the product, specific conditions are employed so as to coarsen the crystalline structure to obtain a controlled and moderate crystal grain size after the annealing. The slab is cold-rolled at a rolling reduction of about 5 to 15% and is subjected to first annealing by heating at a rate of about 3° C./sec or higher and holding the strip for about 5 to 30 seconds at 850° C. to the $A_3$ transformation temperature of the steel, while controlling the crystal grain size to about 100 to 200 μm after first annealing.

9 Claims, 3 Drawing Sheets

METHOD OF PRODUCING NON-ORIENTED ELECTROMAGNETIC STEEL STRIP HAVING SUPERIOR MAGNETIC PROPERTIES AND APPEARANCE

This application is a continuation of application Ser. No. 07/804,830, filed Dec. 6, 1991, now abandoned.

BACKGROUND OF THE INVENTION

1. Field of the Invention

The present invention relates to a method of producing a non-oriented electromagnetic steel strip having superior magnetic properties. More particularly, the present invention is concerned with a method of producing non-oriented electromagnetic steel strip which has a high level of magnetic flux density and superior surface appearance.

2. Description of the Related Art

Non-oriented electromagnetic steel sheets are used as materials of cores of rotating machines such as motors, as well as cores of transformers and stabilizers. To improve efficiency of operation of these electrical cores while reducing their sizes it is necessary to raise the level of the magnetic flux density and to reduce the iron loss of the electromagnetic steel sheet used as the core material.

It has been known that one way of improving magnetic properties of non-oriented electromagnetic steel sheets is to coarsen the crystal grains of the steel strip before cold rolling.

The present inventors have proposed, in Japanese Patent Publication (Kokoku) No. 57-35628, a method for coarsening the crystalline structure of an electromagnetic steel strip which is to be cold-rolled, wherein an electromagnetic steel strip, which is to be cold-rolled, is hot-rolled such that the hot-rolling is finished at a temperature not lower than the $Ar_3$ transformation temperature of the steel which is determined on the basis of the chemical composition of the steel. The hot-rolled steel strip is annealed for at least 30 seconds up to 15 minutes at a temperature not higher than the $A_3$ transformation temperature.

The inventors also proposed, in Japanese Patent Laid-Open (Kokai) No. 2-182831, a method in which hot-rolling of a steel strip is finished at a temperature not lower than the $Ar_3$ transformation temperature and the hot-rolled steel strip is held at a temperature not higher than the A3 transformation temperature for 15 to 30 seconds, followed by cooling which is effected at a controlled cooling rate.

In these methods, however, coarsening of the crystal grains cannot be attained satisfactorily particularly when the annealing time is near the shorter end (30 seconds) of the annealing period, resulting in large fluctuation of the magnetic characteristics. Conversely, when the annealing time approaches the longer limit (15 minutes) of the annealing period, the crystalline structure becomes too coarse so that the appearance of the product is impaired due to roughening or wrinkling of its surface.

Japanese Patent Laid-Open (Kokai) No. 58-136718 discloses a method in which a steel strip is hot-rolled down to a final temperature which is within the $\gamma$-phase region and not more than 50° C. higher than the $Ar_3$ transformation temperature, the strip being then taken-up at a temperature which is not higher than the $A_3$ transformation temperature but not lower than 700° C. so as to coarsen the ferrite crystal grains to a size which is not greater than 100 $\mu$m, thereby improving magnetic properties of the steel strip.

Japanese Patent Laid-Open (Kokai) No. 54-76422 discloses a method in which a hot-rolled steel strip is taken up at a temperature ranging between 750° and 1000° C., and is self-annealed by the heat possessed by the steel strip itself, whereby the steel strip is recrystallized to crystal grains sized between 50 and 70$\mu$m so as to exhibit improved magnetic characteristics.

These known methods for improving magnetic properties by employing take-up temperatures not lower than 700° C. conveniently eliminate the necessity for annealing but suffer from a disadvantage in that, since the take-up temperature is high, both side edge portions of the coiled steel strip are cooled at a greater rate than the breadthwise central portion of the coil and at a higher speed at the starting and terminating ends of the coil than at the mid portion of the coil, which not only produce nonuniform distribution of magnetic properties over the entire coiled steel strip but also impair the effect of pickling which is conducted for the purpose of descaling.

Japanese Patent Publication (Kokoku) No. 45-22211 discloses a method in which a hot-rolled steel strip is cold-rolled at a rolling reduction of 0.5 to 15% and is then subjected to annealing which is conducted for a comparatively long time at a temperature not higher than the $A_3$ transformation temperature, so as to coarsen the crystalline structure of the steel strip thereby reducing iron loss. In this method, however, the annealing after cold rolling is conducted in accordance with a so-called box-annealing method at a temperature of 800° to 850° C. for a comparatively long time of 30 minutes to 20 hours (10 hours in all the illustrated examples). Such a long term annealing is undesirable from the viewpoint of cost and tends to cause excessive coarsening to grain sizes of 180 $\mu$m or greater, leading to inferior appearance of the product.

Japanese Patent Laid-Open (Kokai) No. 1-306523 discloses a method for producing a non-oriented electromagnetic steel sheet having a high level of magnetic flux density, wherein a hot-rolled steel strip is subjected to cold rolling at a small reduction conducted at a rolling reduction of 5 to 20%, followed by annealing for 0.5 to 10 minutes at a temperature ranging from 850°to 1000° C. Annealing is conducted in a continuous annealing furnace in this case but this method uneconomically requires huge equipment because the annealing has to be completed in a short time, e.g., 2 minutes or so as in the illustrated examples.

All these known methods are intended to improve magnetic properties by coarsening the crystalline structure of the steel strip before the strip is subjected to cold-rolling. Unfortunately, these known methods do not provide sufficient combined magnetic properties, product quality and economy of production.

Japanese Patent Laid-Open Nos. 1-139721 and 1-191741 disclose methods of producing semi-processed electromagnetic steel sheets, wherein skin pass rolling is conducted at a rolling reduction of 3 to 15% as the final step. The skin pass rolling for semi-processed steel strip, however, is intended to control the hardness of the rolled product. In order to assure required magnetic properties the skin pass rolling must be followed by a special annealing which must be conducted for a comparatively long time, e.g., 2 hours, at a temperature of, for example, 750° C. Therefore, short-time annealing which is basically conducted by the continuous annealing method, when applied to such semi-processed steel strip, could not stably provide superior magnetic properties.

SUMMARY OF THE INVENTION

Accordingly, an object of the present invention is to provide a method of producing a non-oriented electromagnetic steel strip which excels in magnetic properties, particularly in magnetic flux density, while further providing a product of excellent appearance.

Still another object is to provide a method for optimizing conditions of annealing the strip to coarsen to a carefully controlled degree the crystal grains of steel strip which has been hot-rolled after cold-rolling conducted with small rolling reduction.

To this end, according to the present invention, there is provided a method of producing a non-oriented electromagnetic steel strip which is superior in magnetic properties and appearance.

The slab from which the strip is made contains, by weight, up to about 0.02% of C, up to about 4.0% of Si plus Al or Si alone, up to about 1.0% of Mn, up to about 0.2% of P and the balance substantially Fe, The steps of the method include hot-rolling the slab to form a hot-rolled strip, subjecting the hot-rolled strip to cold-rolling at a rolling reduction between about 5 and 15%, subjecting the cold-rolled strip to annealing controlled to produce a crystal grain size ranging from about 100 to 200 μm, subjecting the annealed strip to cold rolling to reduce the strip thickness to a predetermined thickness, and subjecting the cold-rolled strip to final annealing.

The above and other objects, features and advantages of the present invention will become clear from the following description of the preferred embodiments when read in conjunction with the accompanying drawings.

DESCRIPTION OF THE PREFERRED EMBODIMENTS

A description will now be given regarding specific forms of the method, showing specific procedures actually accomplished, as well as advantageous effects produced, with reference to results achieved by the present invention. This description is not intended to define or to limit the scope of the invention, which is defined in the appended claims.

A slab was formed from a steel melt containing, by weight, 0.010% C, 0.15% Si, 0.25% Mn, 0.08% P, 0.045% Sb, 0.004% S, 0.0008% Al and the balance substantially Fe. The slab was heated to 1250° C. and was hot-rolled to form a hot-rolled steel strip 2.3 mm thick. Subsequently, a cold rolling at a small reduction was applied to the steel strip at a rolling reduction of 0 to 20%, followed by first annealing which was conducted in a continuous annealing furnace for 10 seconds at a temperature of 700° to 1000° C. The rate of heating in the continuous annealing step was 5° C./sec. The $A_3$ transformation temperature of this steel strip was 915° C. Then, after pickling, the steel strip was subjected to ordinary cold-rolling to make a cold-rolled steel strip 0.50 mm thick, followed by final annealing for 75 seconds in a wet atmosphere at 800° C. for decarburization and recrystallization, whereby a final product was obtained.

Figure 1:
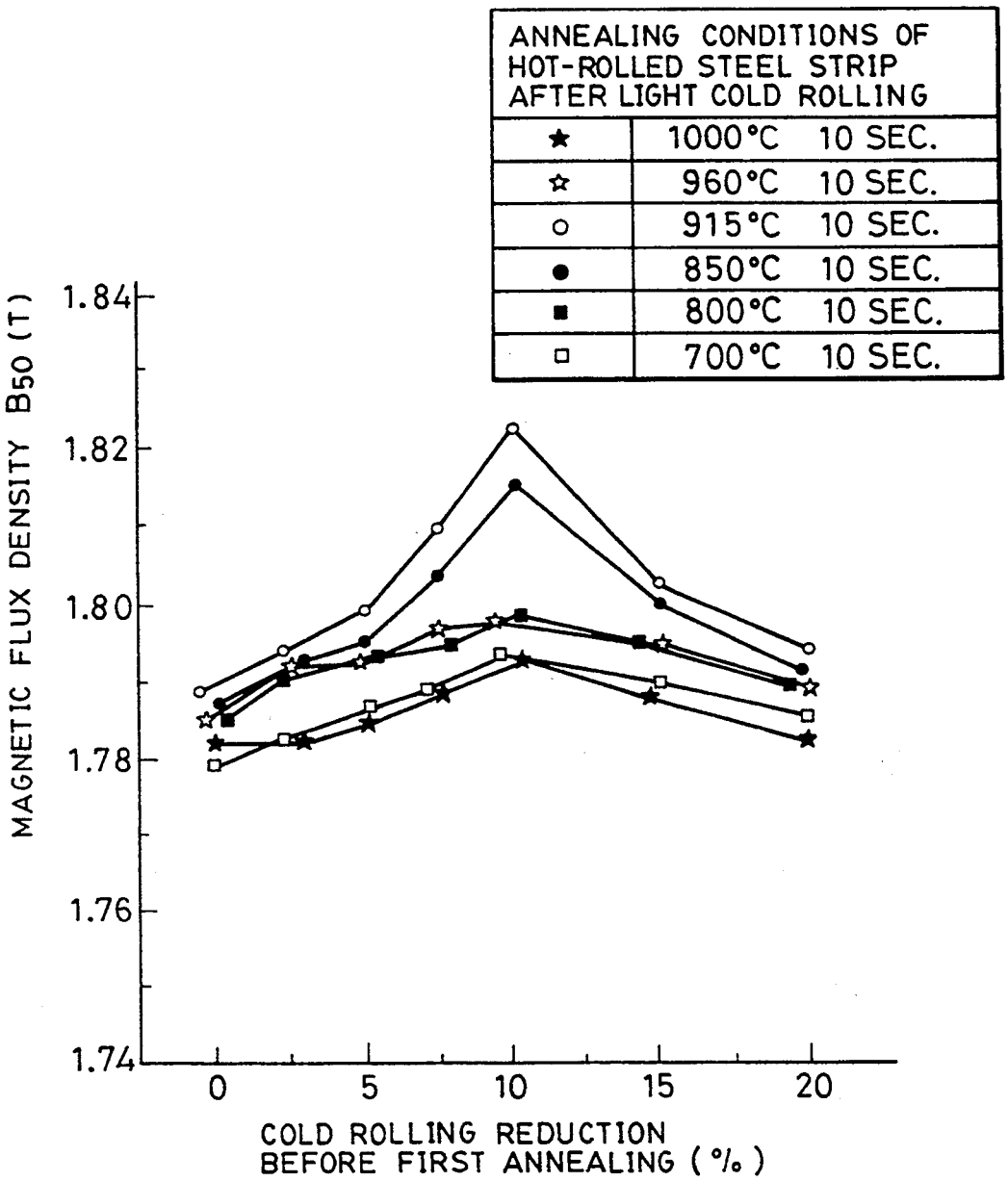
FIG. 1 is a diagram showing the relationship at various temperature conditions between the magnetic flux density $B_{50}$ of a steel strip and the cold rolling reduction percent before first annealing.

The unusual relationship that we have discovered between (a) the percentage of rolling reduction in the step of cold rolling at a small reduction before first annealing and (b) the resulting level of magnetic flux density of the steel strip of this Example is shown in FIG. 1. From the Table in FIG. 1 and from the two uppermost curves, it will be seen that the highest level of magnetic flux density $B_{50}$ is obtained when the cold rolling at a small reduction, conducted at a rolling reduction, is followed by first annealing at a temperature ranging from about 850° C. to 915° C., which is the $A_3$transformation temperature of the steel strip. The sizes of the crystal grains of the steel strip after first annealing, obtained through cold-rolling and first annealing executed under the above-described conditions, ranged between about 100 and 200 μm, and the product strip had a good appearance without substantial wrinkling.

The comparative steel strip which did not show substantial improvement in magnetic flux density $B_{50}$ had crystal grain sizes of less than about 100 μm after first annealing and were outside the scope of this invention.

Thus, appreciable improvement of magnetic flux density can be attained when the hot-rolled steel strip is subjected to cold-rolling at a rolling reduction of about 5 to 15% and subsequent first annealing at a (comparatively high) temperature ranging from about 850° C. to 915° C., which is the $A_3$ transformation temperature, for a very short time of about 10 seconds. This remarkable effect is considered to be attributable to a coarsening of the crystal grains which is caused by the first annealing step and which significantly improves the texture in the final product. The coarsening of the crystal grains effected by the first annealing step is caused by the fact that the step of cold rolling at a small reduction imparts to the hot-rolled steel strip a strain which in turn creates the extraordinary growth of the crystal grains which causes the coarsening phenomenon.

Figure 2:
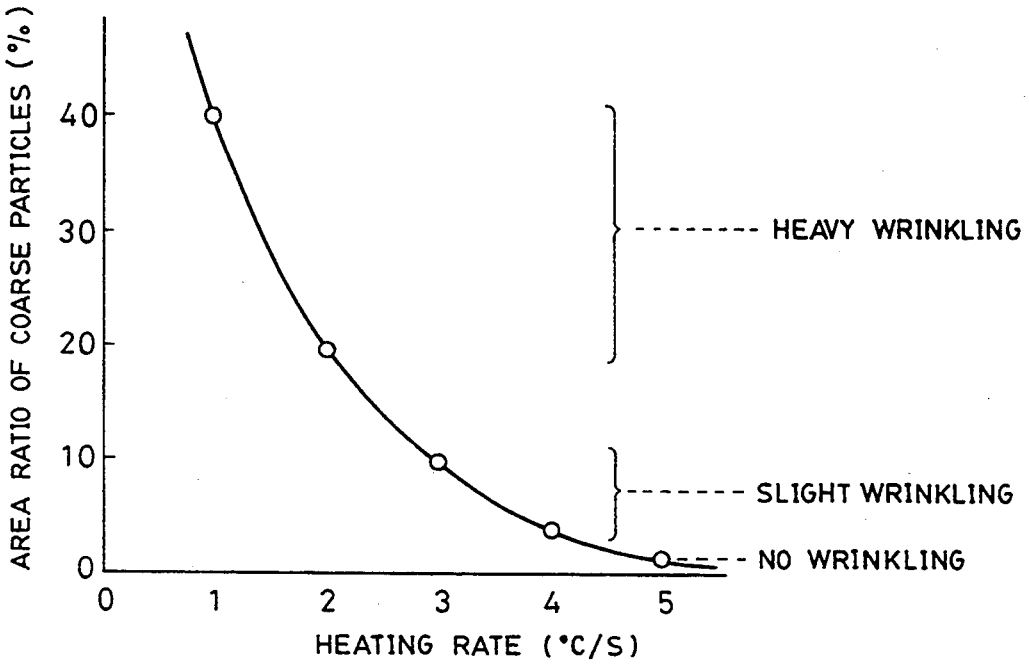
FIG. 2 is a graph showing the relationship between the proportion of coarse crystal grains in the strip and the rate of heating after first annealing.

Further work was also conducted in which a slab was formed from a steel melt containing, by weight, 0.010% C, 0.15% Si, 0.25% Mn, 0.08% P, 0.045% Sb, 0.004% S, 0.0008% Al and the balance substantially Fe, the slab being then heated to 1250° C. and then subjected to ordinary hot rolling to make a hot-rolled steel strip 2.3 mm thick. Then, a step of cold rolling at a small reduction was executed at a rolling reduction of 10%, followed by a short annealing step in a continuous annealing furnace for a (very short) time of 10 seconds at a temperature of 915° C. The rate of anneal heating was varied within the range from 1° C./sec and 5° C./sec. The structure of the steel strip after annealing was observed in order to examine the relationship between the proportion (area ratio) of coarse grains such as those greater than 200 μm and the heating rate, the results being shown in FIG. 2. It will be understood that the coarsening of the crystal grains tends to enhance the generation of wrinkling in the product surface. It will also be seen from FIG. 2 that, for the purpose of improving the nature and appearance of the surface of the product, it is preferred to apply a greater heating rate to decrease the proportion of the coarse crystal grains.

We have also confirmed that a similar effect can be obtained even when the annealing heating temperature is about 850° C. or lower, provided that the crystal grains are coarsened to sizes not smaller than about 100 μm by applying a longer annealing time.

A specific example will now be given showing conditions of cold rolling conducted subsequently to first annealing and conditions of the annealing following cold rolling.

A hot-rolled steel strip of the same composition as that described before was subjected to cold rolling at a rolling reduction of 10% and was subjected to first annealing in which the steel strip was held for 10 seconds at a temperature of 900° C. The crystal grain size of the steel strip at this stage was 120 μm. Cold rolling was effected on the steel strip so as to reduce the thickness of the strip down to 0.50 to 0.65 mm. The cold-rolled steel strip was then subjected to a second annealing conducted at a temperature between 600 and 750° C. so that the crystal grain size was reduced to 10 to 30 μm, followed by cold rolling at a small reduction executed at a rolling reduction of 0 to 20%, down to a strip thickness of 0.50 mm. The steel strip was then subjected to final annealing which was conducted also for a decarburization purpose in a wet atmosphere of 800° C. for 60 seconds. Final products were thus obtained and examined.

Figure 3:
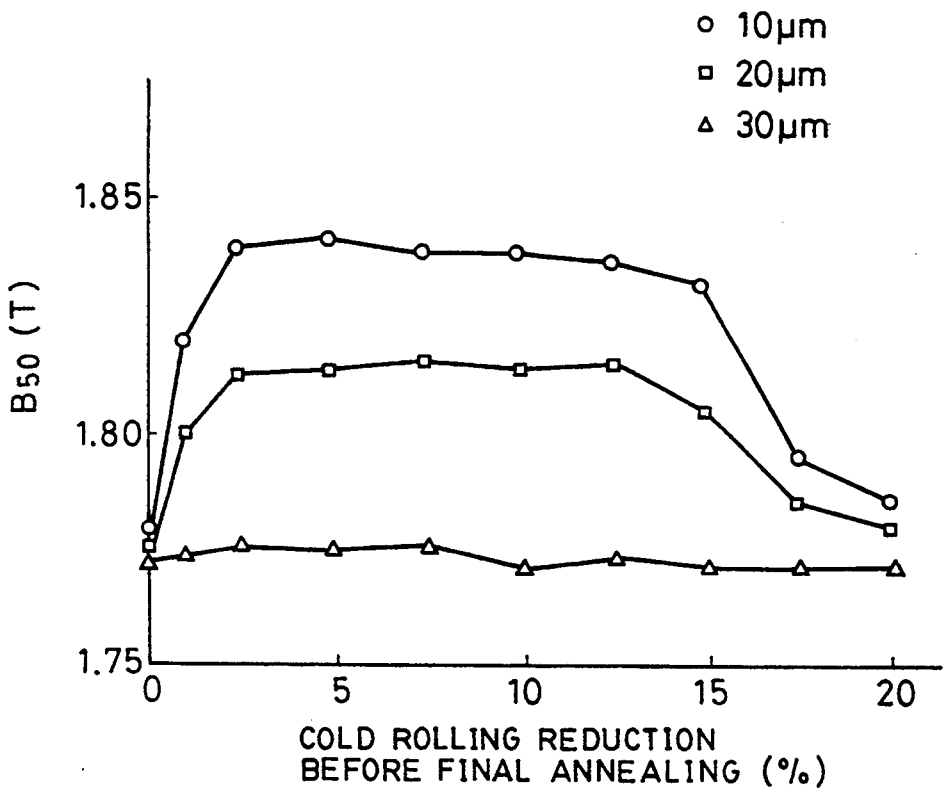
FIG. 3 is a graph showing the relationship among the magnetic flux density of a steel strip product, its crystal grain size before final annealing, and the percentage of applied rolling reduction.

FIG. 3 shows how the magnetic flux density $B_{50}$ of the strip is varied by a change in the crystal grain size after the second annealing and the rolling reduction in the cold rolling at a small reduction. It will be seen that the highest level of magnetic flux density $B_{50}$ was obtained when the cold-rolling and the annealing (which were executed sequentially after the first annealing) were respectively conducted such as to provide a rolling reduction of 1 to 15% and to provide a crystal grain size of 20 μm or less after the secondary annealing. In general, products exhibiting higher levels of magnetic flux density showed good surface conditions without any wrinkling or roughening.

As has been described, according to tile present invention, a further improvement in the magnetic flux density is attained by controlling the crystal grain size obtained after the second annealing executed after the first annealing and by controlling also the amount of rolling reduction in the cold-rolling step executed subsequently to the second annealing. This results from improvement of the texture caused by crystal rotation and selective orientation of the crystal grains during the growth of such crystal grains.

Conditions of the cold rolling executed after hot-rolling and annealing will be explained hereinafter in view of the test results described hereinbefore.

According to the invention the rolling reduction in the step of cold rolling at a small reduction executed after hot-rolling is limited to about 5 to 15%. A rolling reduction value less than about 5% is not sufficient for providing a required level of strain when the first annealing, which is executed after cold rolling at a small reduction for the purpose of controlling the crystal grain size, is conducted in a short period of time at a comparatively high temperature or in a long period of time at a comparatively low temperature. In this case, therefore, the crystal grains are not sufficiently coarsened and cannot reach a size of about 100 μm, so that no remarkable improvement in the magnetic flux density is attained. A rolling reduction value exceeding about 15% is not outstanding and provides essentially the same effect as that produced by ordinary cold-rolling. Cold-rolling at such a large rolling reduction cannot grow the crystal grains to grain sizes of about 100 μm or greater.

According to the invention after cold rolling at a rolling reduction of about 5 to 15%, first annealing is executed under conditions of temperature and time to grow the crystal grains to a size of about 100 to 200 μm. This specific range of crystal grain size is critical and has to be met for the following reasons.

The appearance of the product is seriously degraded when the crystal grain size exceeds about 200 μm. Accordingly, annealing should be executed in such a manner as not to cause the crystal grain size to exceed about 200 μm. On the other hand, crystal grain size below about 100 μm fails to provide appreciable improvement in the magnetic properties of the strip. The first annealing step, therefore, should also be conducted so as not to cause the crystal grain size to develop to a size below about 100 μm.

According to the invention, the first annealing step, which is conducted to obtain a crystal grain size of about 100 to 200 μm, is executed at a heating rate of at least about 3° C./sec. This is because a heating rate less than about 3° C./sec tends to allow a local growth of grains in the structure during the heating, failing to provide uniform and moderate growth of the crystal grains, resulting in coexistence of coarse and fine grains. In order to obviate such a shortcoming, the heating rate is preferably set at a level of at least about 5° C./sec.

During the first annealing step, the steel strip is held at its elevated temperature for a period of about 5 to 30 seconds. This is advantageous in the operating condition of a continuous annealing furnace and is advantageously used for reducing production cost and stabilizing the product quality. It is designed to anneal steel strip in a short period of about 5 to 30 seconds at a comparatively high temperature of about 850° C. to 915° C. When the annealing temperature is below about 850° C. the crystal grains cannot grow to an extent sufficient for improvement of magnetic flux density. More specifically, the annealing temperature is preferably set at a level between about 850° C. and the $A_3$ transformation temperature. When annealing is executed at a temperature outside the above-specified range, crystal grains cannot grow to sizes of about 100 μm or greater, so that the improvement in the magnetic flux density is not appreciable, when the above-mentioned annealing time is less than about 5 seconds. Conversely, when the above-mentioned annealing time exceeds about 30 seconds, the crystal grains tend to become coarsened excessively to sizes exceeding about 200 μm, with product, appearance deteriorated due to wrinkling, although the magnetic flux density may be improved appreciably.

Wrinkling of the product surfaces also undesirably impairs the so-called "space factor" of the strip.

According to the invention, the time at which the steel strip is held at the elevated temperature during the first annealing is selected to range from about 5 to 30 seconds, so as to realize a crystal grain size of about 100 to 200 μm after first annealing, thereby to attain an appreciable improvement of magnetic flux density without being accompanied by degradation of product appearance.

A further description will now be given of specific selected conditions for cold-rolling after first annealing, and of the annealing following the cold-rolling.

According to the invention, the cold-rolling step after first annealing is conducted at a rolling reduction of at least about 50%. This condition has to be met in order to generate strain necessary to obtain the desired crystal grain size in the subsequent second annealing step. The second annealing step should be performed under conditions that the crystal grain size is reduced to about 20 μm or less after annealing. It is considered that a too large crystal grain size undesirably restricts crystal rotation during subsequent cold rolling at a small reduction and impedes suppression of growth of (111) oriented grains in subsequent annealing, the (111) oriented grain being preferably eliminated by development of grains of other orientations.

The cold rolling at a small reduction performed after annealing for the purpose of grain size control has to be done at a rolling reduction of at least about 1%, in order to attain an appreciable improvement in the texture. Cold-rolling at a rolling reduction exceeding about 15%, however, tends to promote recrystallization as is the case of ordinary cold-rolling, preventing improvement of the texture and failing to provide appreciable improvement of magnetic properties.

A description will now be given regarding critical proportions of the respective elements or components of the strip.

The content of C is up to about 0.02% because a C content exceeding this level not only impairs magnetic properties but also impedes decarburization upon final annealing, causing an undesirable effect on the non-aging property of the product.

Si plus Al or Si alone exhibits a high specific resistivity. When the content of Si plus Al or Si alone increases, therefore, iron loss is decreased but the magnetic flux density is lowered. The content, therefore, should be determined according to the levels of the iron loss and magnetic flux densities to be attained, in such a manner as to simultaneously meet both these demands. When the Si plus Al content exceeds about 4.0% the cold-rolling characteristics are seriously impaired. Accordingly, this content should be up to about 4.0%.

Sb and Sn are elements which enhance magnetic flux density through improvement of the texture and, hence, are preferably contained particularly when a specifically high magnetic flux density is required. The content of Sb and Si in total or the content of Sb or Si alone should be determined to be up to about 0.10% because a higher content deteriorates the magnetic properties of the strip.

Mn is an element which is used as a deoxidizer or for the purpose of controlling hot embrittlement which is caused when S is present. The content of Mn, however, should be limited to up to about 1.0% because addition of this element raises the cost of production.

P may be added as an element which enhances hardness to improve the punching characteristics of the product steel. The content of this element, however, should be up to about 0.20% because addition of this element in excess of this value undesirably makes the product fragile.

The following specific Examples of the present invention are intended as illustrative and are not intended to limit the scope of the invention other than defined in the appended claims.

EXAMPLE 1

Continuously cast slabs Nos. 1 to 9, having a chemical composition containing 0.006% C, 0.35% Si, 0.25% Mn, 0.08% P, 0.0009% Al and the balance substantially Fe, were hot-rolled in a conventional manner to steel strip 2.3 mm thick. The $A_3$ transformation temperature of the hot-rolled strip was 955° C.

Each hot-rolled steel strip was then subjected to cold rolling at a small reduction, followed by first annealing. Different rolling reductions and different annealing conditions were applied to individual hot-rolled strip, as shown in Table 1. Subsequently a single cold-rolling step was applied to roll the strip to a final thickness of 0.50 mm, followed by final decarburization/recrystallization annealing which was executed at 850° C. for 75 seconds, whereby final products were obtained.

Table 2 shows the magnetic properties of these products, with and without stress relief annealing conducted at 750° C. for 2 hours, as measured in the form of an Epstein test piece. From Table 2 it will be seen that, when the requirement for the rolling reduction in the cold rolling at a small reduction of hot-rolled steel strip and the conditions for the first annealing are met, crystal grains are coarsened moderately through the first annealing step so that the texture is improved to provide a high level of magnetic flux density $B_{50}$, as well as improved product appearance.

TABLE 1

| Sample Nos. | Class | Cold rolling reduction (%) | First annealing: Heating rate | First annealing: Temp. | First annealing: Time | Crys. grain size after 1st annealing (μm) |
|---|---|---|---|---|---|---|
| 1 | Invention | 10 | 7° C./sec | 900° C. | 10 sec | 120 |
| 2 | | 10 | 7° C./sec | 870° C. | 30 sec | 180 |
| 3 | | 10 | 1° C./sec | 840° C. | 70 sec | 155 |
| 4 | | 8 | 0.02° C./sec | 800° C. | 3 hr | 185 |
| 5 | Comparison examples | 0 | 7° C./sec | 900° C. | 30 sec | 50 |
| 6 | | 3 | 7° C./sec | 900° C. | 30 sec | 70 |
| 7 | | 10 | 7° C./sec | 1000° C. | 30 sec | 50 |
| 8 | | 20 | 5° C./sec | 900° C. | 30 sec | 80 |
| 9 | | 10 | 5° C./sec | 900° C. | 80 sec | 260 |

TABLE 2

| Samples Nos. | Class | After final annealing: $W_{15/50}$ (w/kg) | After final annealing: $B_{50}$ (T) | After stress relief annealing: $W_{15/50}$ (w/kg) | After stress relief annealing: $B_{50}$ (T) | Appearance of product |
|---|---|---|---|---|---|---|
| 1 | Invention | 4.62 | 1.79 | 3.92 | 1.78 | Good |

TABLE 2-continued

| Samples Nos. | Class | After final annealing $W_{15/50}$ (w/kg) | After final annealing $B_{50}$ (T) | After stress relief annealing $W_{15/50}$ (w/kg) | After stress relief annealing $B_{50}$ (T) | Appearance of product |
|---|---|---|---|---|---|---|
| 2 | | 4.51 | 1.79 | 3.85 | 1.78 | Good |
| 3 | | 4.82 | 1.78 | 4.08 | 1.77 | Good |
| 4 | | 4.72 | 1.78 | 3.99 | 1.77 | Good |
| 5 | Comparison | 5.13 | 1.77 | 4.62 | 1.76 | Good |
| 6 | examples | 4.96 | 1.77 | 4.51 | 1.76 | Good |
| 7 | | 5.38 | 1.76 | 4.82 | 1.75 | Good |
| 8 | | 5.10 | 1.77 | 4.58 | 1.75 | Good |
| 9 | | 4.48 | 1.79 | 3.82 | 1.78 | Not good |

Good: No wrinkling
Not good: Wrinkling

EXAMPLE 2

As in Example 1, continuously cast slabs Nos. 10 to 15, having a chemical composition containing 0.007% C, 1.0% Si, 0.30% Mn, 0.018% P, 0.30% Al and the balance substantially Fe, were hot-rolled in a conventional manner to hot-rolled steel strip 2.0 mm thick. The $A_3$ transformation temperature of the hot-rolled strip was 1,050° C.

Each hot-rolled steel strip was then subjected to cold rolling at a small reduction followed by first annealing. Different rolling reductions and different annealing conditions were applied to different hot-rolled strip, as shown in Table 3. Subsequently a single cold-rolling step was executed to roll the strip to a final thickness of 0.50 mm, followed by final decarburization/recrystallization annealing which was executed at 830° C. for 75 seconds, whereby final products were obtained.

Table 4 shows the magnetic properties of these products, with and without stress relief annealing conducted at 750° C. for 2 hours, as measured in the form of Epstein test pieces. From Table 4, it will be seen that the product of this invention has superior magnetic density and surface appearance, when compared with those of the comparison examples.

TABLE 3

| Samples Nos. | Class | Cold rolling reduction (%) | First annealing Heating rate | First annealing Temp. | First annealing Time | Cry. grain size after 1st annealing (μm) |
|---|---|---|---|---|---|---|
| 10 | Inven- | 12 | 5° C./sec | 950° C. | 30 sec | 200 |
| 11 | tion | 7 | 5° C./sec | 950° C. | 10 sec | 160 |
| 12 | Com- | 0 | 5° C./sec | 950° C. | 30 sec | 60 |
| 13 | parison | 10 | 7° C./sec | 1080° C. | 30 sec | 50 |
| 14 | exam- | 20 | 7° C./sec | 950° C. | 30 sec | 80 |
| 15 | ples | 7 | 5° C./sec | 950° C. | 90 sec | 410 |

TABLE 4

| Samples Nos. | Class | After final annealing $W_{15/50}$ (w/kg) | After final annealing $B_{50}$ (T) | After stress relief annealing $W_{15/50}$ (w/kg) | After stress relief annealing $B_{50}$ (T) | Appearance of product |
|---|---|---|---|---|---|---|
| 10 | Invention | 4.00 | 1.78 | 3.62 | 1.77 | Good |
| 11 | | 4.13 | 1.78 | 3.70 | 1.77 | Good |
| 12 | Comparison | 4.61 | 1.76 | 4.29 | 1.75 | Good |
| 13 | examples | 4.77 | 1.75 | 4.36 | 1.75 | Good |
| 14 | | 4.58 | 1.76 | 4.19 | 1.75 | Good |
| 15 | | 4.10 | 1.78 | 3.63 | 1.77 | Not good |

Example 3

Continuously cast slabs Nos. 16 to 22, having a chemical composition containing 0.005% C, 0.33% Si, 0.25% Mn, 0.07% P, 0.0008% Al, 0.050% Sb and the balance substantially Fe, were hot-rolled in a conventional manner to hot-rolled steel strip 2.3 mm thick. The $A_3$ transformation temperature of the hot-rolled strip was 950° C.

Each hot-rolled steel strip was then subjected to a cold rolling at a small reduction, followed by first annealing. Different rolling reductions and different annealing conditions were applied to different hot-rolled strip, as shown in Table 5. Subsequently, a single cold-rolling step was executed to roll the strip to a final thickness of 0.50 mm, followed by final decarburization/recrystallization annealing which was executed at 810° C. for 60 seconds, whereby final products were obtained. Table 6 shows the magnetic properties of these products, with and without stress relief annealing conducted at 750° C. for 2 hours, as measured in the form of Epstein test pieces. From Table 6 it will be seen that, when the requirement for the rolling reduction in the cold rolling at a small reduction of hot-rolled strip and the conditions of the subsequent annealing in accordance with the invention are met, it is possible to obtain electromagnetic steel strip having a high level off magnetic flux density and superior appearance.

TABLE 5

| Samples Nos. | Class | Cold rolling reduction (%) | First annealing Heating rate | First annealing Temp. | First annealing Time | Crys. grain size after 1st annealing (μm) |
|---|---|---|---|---|---|---|
| 16 | Inven- | 10 | 7° C./sec | 930° C. | 10 sec | 120 |
| 17 | tion | 10 | 7° C./sec | 880° C. | 30 sec | 180 |
| 18 | Com- | 0 | 7° C./sec | 930° C. | 30 sec | 55 |
| 19 | parison | 3 | 7° C./sec | 930° C. | 30 sec | 70 |
| 20 | examples | 10 | 7° C./sec | 1000° C. | 30 sec | 50 |
| 21 | | 10 | 7° C./sec | 900° C. | 80 sec | 250 |
| 22 | | 10 | 2° C./sec | 880° C. | 30 sec | 240 |

TABLE 6

| Samples Nos. | Class | After final annealing $W_{15/50}$ (w/kg) | After final annealing $B_{50}$ (T) | After stress relief annealing $W_{15/50}$ (w/kg) | After stress relief annealing $B_{50}$ (T) | Appearance of product |
|---|---|---|---|---|---|---|
| 16 | Invention | 4.58 | 1.81 | 3.78 | 1.80 | Good |
| 17 | | 4.40 | 1.81 | 3.70 | 1.81 | Good |
| 18 | Comparison | 5.00 | 1.78 | 4.57 | 1.77 | Good |
| 19 | examples | 4.83 | 1.79 | 4.32 | 1.78 | Good |
| 20 | | 5.30 | 1.77 | 4.78 | 1.76 | Good |
| 21 | | 4.38 | 1.81 | 3.66 | 1.81 | Not good |
| 22 | | 4.53 | 1.80 | 3.81 | 1.80 | Not good |

EXAMPLE 4

Continuously cast slab Nos. 23 to 28, having a chemical composition containing 0.008% C, 1.1% Si, 0.28% Mn, 0.018% P, 0.31% Al, 0.055% Sn and the balance substantially Fe, and continuously cast slabs Nos. 29 to 31, containing 0.007% C, 1.1% Si, 0.30% Mn, 0.019% P, 0.30% Al, 0.03% Sb, 0.03% Sn and the balance substantially Fe, were hot-rolled in a conventional manner to hot-rolled steel strip 2.0 mm thick. The $A_3$ transformation temperature of the hot-rolled strip produced from slab Nos. 23 to 28 was 1045° C. while the $A_3$ transformation temperature of the strip rolled from slabs Nos. 29 to 31 was 1055° C.

Each hot-rolled steel strip was then subjected to cold rolling at a small reduction followed by first annealing. Different rolling reductions and different annealing conditions were applied to different hot-rolled strip, as shown in Table 7. Subsequently, a single cold-rolling step was executed to roll each strip to a final thickness of 0.50 mm, followed by final decarburization/recrystallization annealing which was executed at 830° C. for 75 seconds, whereby final products were obtained. Table 8 shows the magnetic properties of these products, with and without stress relief annealing conducted at 750° C. for 2 hours, as measured in the form of Epstein test pieces. From Table 8 it will be seen that the strip produced by the processes meeting the requirements of the present invention were superior both in the magnetic flux density and appearance.

TABLE 7

| Samples Nos. | Class | Cold rolling reduction (%) | First annealing Heating rate | Temp. | Time | Cry. grain size after 1st annealing (μm) |
|---|---|---|---|---|---|---|
| 23 | Invention | 13 | 5° C./sec | 950° C. | 30 sec | 190 |
| 24 | | 7 | 5° C./sec | 950° C. | 10 sec | 160 |
| 30 | | 10 | 5° C./sec | 950° C. | 30 sec | 200 |
| 25 | Comparison examples | 0 | 5° C./sec | 950° C. | 30 sec | 55 |
| 26 | | 10 | 5° C./sec | 1080° C. | 30 sec | 45 |
| 27 | | 20 | 5° C./sec | 950° C. | 30 sec | 80 |
| 28 | | 7 | 5° C./sec | 950° C. | 100 sec | 430 |
| 29 | | 0 | 5° C./sec | 950° C. | 30 sec | 55 |
| 31 | | 10 | 1° C./sec | 950° C. | 30 sec | 260 |

TABLE 8

| Samples Nos. | Class | After final annealing $W_{15/50}$ (w/kg) | After final annealing $B_{50}$ (T) | After stress relief annealing $W_{15/50}$ (w/kg) | After stress relief annealing $B_{50}$ (T) | Appearance of product |
|---|---|---|---|---|---|---|
| 23 | Invention | 3.90 | 1.80 | 3.51 | 1.79 | Good |
| 24 | | 3.96 | 1.79 | 3.62 | 1.79 | Good |
| 30 | | 3.89 | 1.80 | 3.48 | 1.79 | Good |
| 25 | Comparison examples | 4.50 | 1.77 | 4.20 | 1.76 | Good |
| 26 | | 4.67 | 1.76 | 4.37 | 1.76 | Good |
| 27 | | 4.49 | 1.77 | 4.10 | 1.76 | good |
| 28 | | 3.89 | 1.80 | 3.49 | 1.79 | Not good |
| 29 | | 4.53 | 1.77 | 4.23 | 1.76 | Good |
| 31 | | 3.98 | 1.79 | 3.55 | 1.78 | Not good |

EXAMPLE 5

Continuously cast slabs Nos. 32 to 48, having a chemical composition containing 0.007% C, 0.15% Si, 0.25% Mn, 0.03% P, 0.0008% Al and the balance substantially Fe, were hot-rolled by ordinary hot-rolling so as to make hot-rolled steel strip 2.0 mm thick. The strip had $A_3$ transformation temperatures of 920° C.

Each strip was treated under first annealing conditions shown in Table 9 so that structures having crystal grain sizes as shown in the same Table were obtained. Each first-annealed strip was then cold-rolled down to 0.50 to 0.60 mm and subjected to second annealing conducted at 600° to 800° C. so as to obtain structures having crystal grain sizes as shown in Table 9. Each second-annealed strip was further subjected to cold-rolling conducted at rolling reductions as shown in Table 9 down to 0.50 mm thickness, and then subjected to final decarburization annealing conducted at 800° C. for 75 seconds, whereby final products were obtained. Table 9 shows the properties of the products as measured by Epstein test pieces, as well as the conditions of the strip surfaces. Properties and surface qualities of the products, which were produced by annealing the strip after the second cold-rolling, are also shown by way of Comparison Examples. It will be seen that the products produced by processes meeting the conditions of the present invention are superior both in magnetic flux density and appearance, as compared with the Comparison Examples.

EXAMPLE 6

Continuously cast slabs Nos. 49 to 65, having a chemical composition containing 0.006% C, 0.18% Si, 0.25% Mn, 0.03% P, 0.0011% Al, 0.06% Sb and the balance substantially Fe, were hot-rolled by ordinary hot-rolling to hot-rolled steel strip 2.0 mm thick. Each strip had an $A_3$ transformation temperature of 925° C.

Each strip was treated under first annealing conditions shown in Table 10 so that structures having crystal grain sizes as shown in the same Table were obtained. The first-annealed strip was then cold-rolled down to 0.50 to 0.60 mm and was subjected to second annealing conducted at 600° to 800° C. so as to obtain structures having crystal grain sizes as shown in Table 10. Each second-annealed strip was further subjected to cold-rolling conducted at rolling reductions as shown in Table 10 down to 0.50 mm in thickness, and then subjected to final decarburization annealing conducted at 800° C. for 75 seconds, whereby final products were obtained. Table 10also shows the properties of the products as measured by Epstein test pieces, as well as the conditions of the product surfaces. Properties and surface qualities of products, which were produced by annealing the strip after second cold-rolling, are also shown by way of Comparison Examples. It will be seen that the products produced by the present invention were superior both in magnetic flux density and appearance, as compared with the Comparison Examples.

TABLE 9

| Samples | Cold rolling reduction (%) | First annealing conditions | Crystal grain size after 1st annealing (μm) | Crystal grain size after 2nd annealing (μm) | Cold rolling reduction before final annealing (%) | Product $W_{15/50}$ | Product $B_{50}$ | Product Surface state | Class |
|---|---|---|---|---|---|---|---|---|---|
| 32 | 10 | 860° C. × 20s | 120 | 10 | 3 | 4.43 | 1.84 | Good | Invention |
| 33 | 5 | 910° C. × 15s | 140 | 8 | 5 | 4.39 | 1.83 | Good | Invention |
| 34 | 7 | 900° C. × 5s | 110 | 8 | 2 | 4.46 | 1.84 | Good | Invention |
| 35 | 7 | 850° C. × 30s | 130 | 9 | 7 | 4.28 | 1.83 | Good | Invention |
| 36 | 12 | 880° C. × 45s | 170 | 12 | 1 | 4.31 | 1.84 | Good | Invention |
| 37 | 10 | 895° C. × 25s | 125 | 7 | 5 | 4.36 | 1.83 | Good | Invention |
| 38 | 10 | 800° C. × 2h* | 180 | 20 | 3 | 4.41 | 1.83 | Good | Invention |
| 39 | 8 | 780° C. × 3h* | 160 | 16 | 15 | 4.25 | 1.85 | Good | Invention |
| 40 | 2 | 860° C. × 5s | 140 | 9 | 8 | 4.62 | 1.78 | Good | Comp. Ex. |
| 41 | 7 | 930° C. × 30s | 68 | 7 | 5 | 4.71 | 1.76 | Good | Comp. Ex. |
| 42 | 8 | 850° C. × 2h* | 208 | 18 | 4 | 4.34 | 1.82 | Not good | Comp. Ex. |

TABLE 9-continued

| Samples | Cold rolling reduction (%) | First annealing conditions | Crystal grain size after 1st annealing (μm) | Crystal grain size after 2nd annealing (μm) | Cold rolling reduction before final annealing (%) | Product $W_{15/50}$ | Product $B_{50}$ | Product Surface state | Class |
|---|---|---|---|---|---|---|---|---|---|
| 43 | 6 | 890° C. × 30s | 140 | 22 | 5 | 4.81 | 1.72 | Good | Comp. Ex. |
| 44 | 12 | 880° C. × 40s | 165 | 16 | 0 | 4.62 | 1.79 | Good | Comp. Ex. |
| 45 | 10 | 860° C. × 20s | 120 | 10 | 16 | 4.71 | 1.77 | Good | Comp. Ex. |
| 46 | 3 | 830° C. × 30s | 76 | 6 | 8 | 4.82 | 1.72 | Good | Comp. Ex. |
| 47 | 17 | 900° C. × 30s | 85 | 9 | 11 | 5.01 | 1.70 | Good | Comp. Ex. |
| 48 | 5 | 895° C. × 25s | 115 | 13 | ** | 4.85 | 1.73 | Good | Comp. Ex. |

*Batch annealing
**Product obtained through cold rolling with large rolling reduction

TABLE 10

| Samples | Cold rolling reduction (%) | First annealing conditions | Crystal grain size after 1st annealing (μm) | Crystal grain size after 2nd annealing (μm) | Cold rolling reduction before final annealing (%) | Product $W_{15/50}$ | Product $B_{50}$ | Product Surface state | Class |
|---|---|---|---|---|---|---|---|---|---|
| 49 | 5 | 885° C. × 20s | 160 | 10 | 4 | 4.21 | 1.85 | Good | Invention |
| 50 | 10 | 925° C. × 10s | 105 | 9 | 8 | 4.33 | 1.84 | Good | Invention |
| 51 | 7 | 900° C. × 30s | 120 | 8 | 6 | 4.16 | 1.86 | Good | Invention |
| 52 | 5 | 850° C. × 25s | 140 | 10 | 6 | 4.28 | 1.85 | Good | Invention |
| 53 | 5 | 875° C. × 5s | 180 | 9 | 2 | 4.31 | 1.84 | Good | Invention |
| 54 | 10 | 910° C. × 15s | 116 | 8 | 8 | 4.25 | 1.84 | Good | Invention |
| 55 | 6 | 870° C. × 65s | 135 | 12 | 14 | 4.25 | 1.83 | Good | Invention |
| 56 | 3 | 800° C. × 2h* | 160 | 15 | 5 | 4.16 | 1.84 | Good | Invention |
| 57 | 12 | 820° C. × 3h* | 195 | 18 | 15 | 4.22 | 1.84 | Good | Invention |
| 58 | 6 | 950° C. × 15s | 65 | 9 | 5 | 4.62 | 1.80 | Good | Comp. Ex. |
| 59 | 18 | 890° C. × 30s | 75 | 12 | 6 | 4.55 | 1.81 | Good | Comp. Ex. |
| 60 | 7 | 920° C. × 20s | 155 | 25 | 12 | 4.66 | 1.80 | Good | Comp. Ex. |
| 61 | 9 | 860° C. × 30s | 130 | 16 | 0 | 4.59 | 1.81 | Good | Comp. Ex. |
| 62 | 11 | 910° C. × 10s | 120 | 12 | 18 | 4.72 | 1.79 | Good | Comp. Ex. |
| 63 | 6 | 845° C. × 2h* | 225 | 18 | 6 | 4.30 | 1.83 | Not good | Comp. Ex. |
| 64 | 2 | 880° C. × 25s | 195 | 15 | 3 | 4.51 | 1.81 | Good | Comp. Ex. |
| 65 | 9 | 900° C. × 30s | 160 | 8 | ** | 4.63 | 1.80 | Good | Comp. Ex. |

*Batch annealing
**Product obtained through cold rolling with large rolling reduction

EXAMPLE 7

Continuously cast slabs Nos. 66 to 82, having a chemical composition containing 0.008% C, 0.35% Si, 0.35% Mn, 0.05% P, 0.0012% Al, 0.05% Sb, 0.03% Sn and the balance substantially Fe. The slabs were hot-rolled by an ordinary hot-rolling process to hot-rolled steel strip 2.0 mm thick. Each strip had an $A_3$ transformation temperature of 940° C.

Each strip was treated under first annealing conditions shown in Table 11 so that structures having crystal grain sizes as shown in the same Table were obtained. Each first-annealed strip was then cold-rolled down to 0.50 to 0.60 mm and subjected to second annealing conducted at 600° to 800° C. so as to obtain structures having crystal grain sizes as shown in Table 11. Each second-annealed strip was further subjected to cold-rolling conducted at rolling reductions as shown in Table 11 down to 0.50 mm in thickness, and then subjected to final decarburization annealing conducted at 800° C. for 75 seconds, whereby final products were obtained. Table 11 also shows the result of measurement of the properties of the products as measured by Epstein test pieces, as well as the conditions of the product surfaces. Properties and surface qualities of products, which were produced by annealing the strip after second cold-rolling, are also shown by way of Comparison Examples. It will be seen that the products produced by the present invention are superior both in magnetic flux density and appearance, as compared with the Comparison Examples.

TABLE 11

| Samples | Cold rolling reduction (%) | First annealing conditions | Crystal grain size after 1st annealing (μm) | Crystal grain size after 2nd annealing (μm) | Cold rolling reduction before final annealing (%) | Product $W_{15/50}$ | Product $B_{50}$ | Product Surface state | Class |
|---|---|---|---|---|---|---|---|---|---|
| 66 | 10 | 925° C. × 25s | 140 | 9 | 8 | 4.16 | 1.85 | Good | Invention |
| 67 | 12 | 850° C. × 5s | 105 | 10 | 6 | 4.22 | 1.84 | Good | Invention |
| 68 | 5 | 875° C. × 15s | 120 | 8 | 8 | 4.31 | 1.85 | Good | Invention |
| 69 | 8 | 915° C. × 25s | 180 | 10 | 4 | 4.27 | 1.85 | Good | Invention |
| 70 | 15 | 940° C. × 30S | 190 | 8 | 6 | 4.18 | 1.86 | Good | Invention |
| 71 | 10 | 860° C. × 18s | 110 | 9 | 6 | 4.25 | 1.84 | Good | Invention |
| 72 | 6 | 900° C. × 45s | 150 | 12 | 2 | 4.31 | 1.84 | Good | Invention |
| 73 | 10 | 800° C. × 3h* | 170 | 17 | 12 | 4.29 | 1.85 | Good | Invention |
| 74 | 14 | 800° C. × 2h* | 175 | 19 | 14 | 4.17 | 1.86 | Good | Invention |
| 75 | 5 | 950° C. × 35s | 65 | 10 | 6 | 4.65 | 1.79 | Good | Comp. Ex. |
| 76 | 18 | 885° C. × 18s | 70 | 5 | 6 | 4.66 | 1.80 | Good | Comp. Ex. |
| 77 | 12 | 930° C. × 60s | 205 | 19 | 5 | 4.21 | 1.83 | Not good | Comp. Ex. |
| 78 | 6 | 920° C. × 30s | 120 | 22 | 3 | 4.56 | 1.79 | Good | Comp. Ex. |
| 79 | 3 | 930° C. × 45s | 85 | 12 | 4 | 4.63 | 1.79 | Good | Comp. Ex. |

TABLE 11-continued

| Samples | Cold rolling reduction (%) | First annealing conditions | Crystal grain size after 1st annealing (μm) | Crystal grain size after 2nd annealing (μm) | Cold rolling reduction before final annealing (%) | Product $W_{15/50}$ | Product $B_{50}$ | Product Surface state | Product Class |
|---|---|---|---|---|---|---|---|---|---|
| 80 | 9 | 880° C. × 40s | 120 | 16 | 0 | 4.71 | 1.78 | Good | Comp. Ex. |
| 81 | 6 | 870° C. × 2h* | 145 | 17 | 18 | 4.62 | 1.79 | Good | Comp. Ex. |
| 82 | 10 | 910° C. × 30s | 165 | 18 | ** | 4.55 | 1.80 | Good | Comp. Ex. |

*Batch annealing
**Product obtained through cold rolling with large rolling reduction Example 8

Continuously cast slabs Nos. 83 to 87, having a chemical composition containing 0.002% C, 3.31% Si, 0.16% Mn, 0.02% P, 0.64% Al and the balance substantially Fe, slabs Nos. 88 to 92, having a chemical composition consisting of 0.003% C, 3.25% Si, 0.15% Mn, 0.02% P, 0.62% Al, 0.05% Sb and the balance substantially Fe, and slabs Nos. 93 to 97, having a composition consisting of 0.002% C, 3.2% Si, 0.17% Mn, 0.02% P, 0.58% Al, 0.03% Sb, 0.04% Sn and the balance substantially Fe, were treated by ordinary hot-rolling to hot-rolled steel strip 2.0 mm thick. Because of high Si content, transformation of the strip did not occur.

Each strip was treated under first annealing conditions shown in Table 12 so that structures having crystal grain sizes as shown in the same Table were obtained. Each first-annealed strip was then cold-rolled down to 0.50 to 0.60 mm and subjected to a second annealing step conducted at 600° to 800° C. so as to obtain structures having crystal grain sizes as shown in Table 12. Each second-annealed strip was further subjected to cold-rolling conducted at rolling reductions as shown in Table 12 down to 0.50 mm in thickness, and then subjected to final recrystallizing annealing conducted at 1000° C. for 30 seconds, whereby final products were obtained. Table 12 also shows the result of measurement of the properties of the products as measured by Epstein test pieces, as well as the conditions of the product surfaces.

TABLE 12

| Samples | Cold rolling reduction (%) | First annealing conditions | Crystal grain size after 1st annealing (μm) | Crystal grain size after 2nd annealing (μm) | Cold rolling reduction before final annealing (%) | Product $W_{15/50}$ | Product $B_{50}$ | Product Surface state | Product Class |
|---|---|---|---|---|---|---|---|---|---|
| 83 | 5 | 975° C. × 10s | 125 | 8 | 3 | 2.25 | 1.68 | Good | Invention |
| 84 | 10 | 1030° C. × 20s | 175 | 16 | 6 | 2.16 | 1.69 | Good | Invention |
| 85 | 12 | 1000° C. × 30s | 160 | 12 | 12 | 2.23 | 1.68 | Good | Invention |
| 86 | 18 | 950° C. × 40s | 77 | 6 | 8 | 2.44 | 1.67 | Good | Comp. Ex. |
| 87 | 9 | 1025° C. × 30s | 225 | 25 | 9 | 2.18 | 1.69 | Not good | Comp. Ex. |
| 88 | 8 | 1025° C. × 60s | 190 | 17 | 14 | 2.17 | 1.69 | Good | Invention |
| 89 | 10 | 920° C. × 90s | 115 | 10 | 7 | 2.09 | 1.69 | Good | Invention |
| 90 | 15 | 1000° C. × 30s | 120 | 9 | 2 | 2.11 | 1.69 | Good | Invention |
| 91 | 10 | 1030° C. × 30s | 190 | 22 | 5 | 2.24 | 1.68 | Not good | Comp. Ex. |
| 92 | 3 | 995° C. × 30s | 85 | 9 | 10 | 2.46 | 1.66 | Good | Comp. Ex. |
| 93 | 5 | 1000° C. × 30s | 120 | 8 | 15 | 2.16 | 1.69 | Good | Invention |
| 94 | 15 | 960° C. × 70s | 155 | 11 | 5 | 2.12 | 1.69 | Good | Invention |
| 95 | 10 | 1025° C. × 20s | 170 | 13 | 10 | 2.18 | 1.69 | Good | Invention |
| 96 | 10 | 1000° C. × 60s | 180 | 15 | 18 | 2.55 | 1.65 | Good | Comp. Ex. |
| 97 | 8 | 980° C. × 30s | 160 | 25 | 10 | 2.47 | 1.66 | Not good | Comp. Ex. |

As will be seen from the foregoing description, according to the present invention, it is possible to produce, stably and at a reduced cost, non-oriented electromagnetic steel strip having a high level of magnetic flux density, as well as superior appearance, by a process in which a hot-rolled steel strip is treated through sequential steps including moderate cold rolling at a small reduction and first annealing conducted for the purpose of controlling crystal grain size to a moderate size, followed by cold rolling and subsequent annealing.

Although this invention has been disclosed with respect to large numbers of specific examples, it will be appreciated that many variations of the method may be used without departing from the spirit and scope of the invention. For example, non-essential method steps may be added or taken away and equivalent method steps may be substituted without departing from the spirit and scope of the invention as defined in the appended claims.

What is claimed is:

1. A method of producing a non-oriented electromagnetic steel strip having superior magnetic properties and appearance, comprising the steps of:

preparing a slab from a steel which includes components consisting essentially of, by weight, up to about 0.02% of C, up to about 4.0% of Si plus Al or Si alone, up to about 1.0% of Mn, up to about 0.2% of P and the balance substantially Fe;

hot-rolling said slab to form a hot-rolled strip;

subjecting said hot-rolled strip to a first cold rolling conducted at a rolling reduction controlled between about 5 and 15% to form a first cold-rolled strip;

subjecting the first cold-rolled strip to a first annealing step;

controlling the temperature and duration of said first annealing step to produce a crystal grain size ranging from about 100 to 200 μm after said first annealing, wherein said first cold-rolled strip is heated at a rate of between about 3° C./sec and 7° C./sec and a maximum temperature is maintained for about 5 to 30 seconds;

subjecting the resulting annealed strip to cold rolling to reduce the annealed strip thickness; and subjecting the resulting cold-rolled strip to final annealing.

2. A method according to claim 1, wherein said slab comprises, by weight, up to about 0.02% of C, up to about 4.0% of Si plus Al or Si alone, up to about 1.0% of Mn, up to about 0.2% of P, up to about 0.10% of one or two elements selected from the group consisting of Sb and Sn, and the balance substantially Fe.

3. A method according to claim 1, wherein said first annealing step is conducted by heating said first cold-rolled strip at a heating rate of at least about 3° C./sec, and holding said strip at an elevated temperature of at least about 850° C. for about 5 to 30 seconds.

4. A method according to claim 1, wherein said cold-rolling step subsequent to said first annealing step is conducted at a rolling reduction of at least about 50%, and a second annealing step is conducted after said cold-rolling step so that the crystal grain size of said second annealed strip is reduced to about 20 μm, and further cold-rolling to reduce the second annealed strip thickness is conducted at a rolling reduction of about 1 to 15%, followed by said final annealing.

5. A method according to claim 1, wherein said first annealing step subsequent to said first cold rolling at a small reduction is conducted at a temperature of about 850° to the $A_3$ transformation temperature of the steel.

6. A method according to claim 1, wherein said first annealing step subsequent to said first cold-rolling at a small reduction is conducted at a temperature of about 850° C. to the $A_3$ transformation temperature of the steel, and wherein said first annealing step subsequent to said first cold rolling at a small reduction is conducted for a time of about 5 to 30 seconds.

7. A method according to claim 1, wherein said first annealing step subsequent to said first cold-rolling at a small reduction is conducted for a time of about 10 seconds.

8. A method of producing a non-oriented electromagnetic steel strip having superior magnetic properties and appearance, comprising the steps of:

preparing a steel slab;

hot-rolling said slab to form a hot-rolled strip;

subjecting said hot-rolled strip to cold rolling conducted at a rolling reduction controlled between about 5 and 15%;

subjecting the cold-rolled strip to a first annealing step, wherein said first annealing step is conducted by heating said cold-rolled strip at a rate of about 3° C./sec to 7° C./sec, at a temperature of about 850° C. to the $A_3$ transformation temperature of the steel and is conducted for a time of about 5 to 30 seconds;

controlling the temperature and duration of said first annealing step to produce a crystal grain size ranging from about 100 to 200 μm after said first annealing;

subjecting the resulting annealed strip to cold rolling to reduce the annealed strip thickness; and subjecting the resulting cold-rolled strip to final annealing.

9. A method according to claim 8, wherein said cold-rolling step subsequent to said first annealing step is conducted at a rolling reduction of at least about 50%, and a second annealing step is conducted after said cold-rolling step so that the crystal grain size of said second annealed strip is reduced to about 20 μm, and further cold-rolling after second annealing is conducted at a rolling reduction of about 1 to 15%, followed by said final annealing.

* * * * *